United States Patent [19]

Rijckaert

[11] 4,267,848

[45] May 19, 1981

[54] METHOD AND DEVICE FOR CONDITIONING TOBACCO LEAVES OR PARTS THEREOF IN A COIL OR BOBBIN

[75] Inventor: Franciscus N. Rijckaert, RR Vught, Netherlands

[73] Assignee: B. V. Arenco P.M.B., Best, Netherlands

[21] Appl. No.: 51,064

[22] Filed: Jun. 22, 1979

[30] Foreign Application Priority Data

Jul. 18, 1978 [NL] Netherlands ..... 7807682

[51] Int. Cl.[3] ..... A24B 3/12

[52] U.S. Cl. ..... 131/304; 131/306; 131/316

[58] Field of Search ..... 131/136, 135, 134, 133 R, 131/140 R, 149, 148

[56] References Cited

U.S. PATENT DOCUMENTS

| | | | |
|---|---|---|---|
| 2,799,278 | 7/1957 | Bogarty | 131/137 X |
| 3,240,212 | 3/1966 | Royster | 131/121 X |
| 3,502,085 | 3/1970 | Wochnowski | 131/121 X |
| 3,542,038 | 11/1970 | Hooper et al. | 131/148 X |
| 4,128,214 | 12/1978 | Maas | 131/149 X |

*Primary Examiner*—Stephen C. Pellegrino

*Attorney, Agent, or Firm*—Diller, Ramik & Wight

[57] ABSTRACT

A method and a device for conditioning tobacco leaves or parts thereof in a coil or bobbin in which the tobacco material is conducted towards or away from a stretched belt portion of a reel, wherein a conditioning medium is continuously fed to the windings of the bobbin containing the tobacco material and to at least part of the belt portion extending away therefrom in order to control the tobacco leaf material already during winding on or off respectively of the bobbin so that the aforesaid storage and treatment conditions respectively can be better controlled.

12 Claims, 3 Drawing Figures

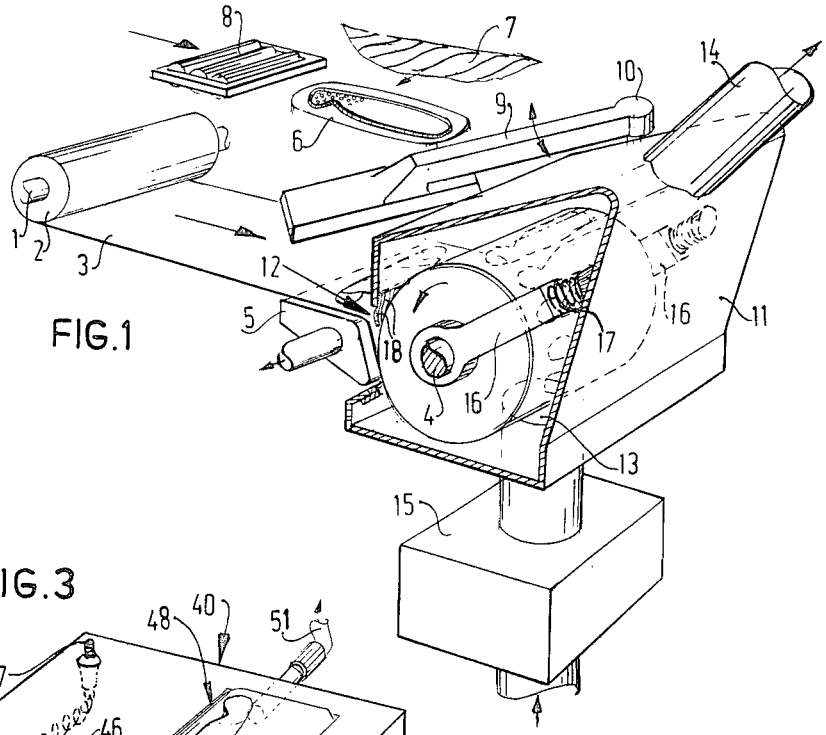
FIG.1
FIG.3
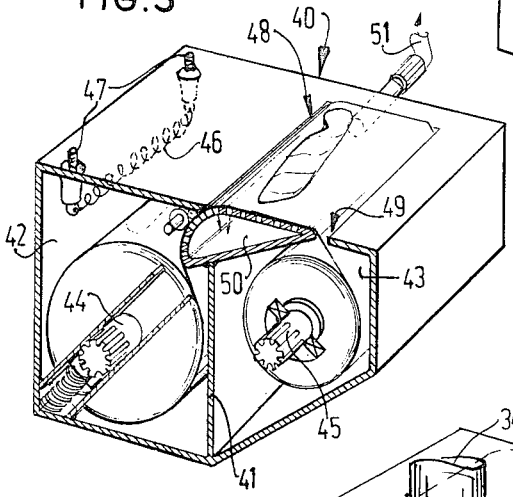
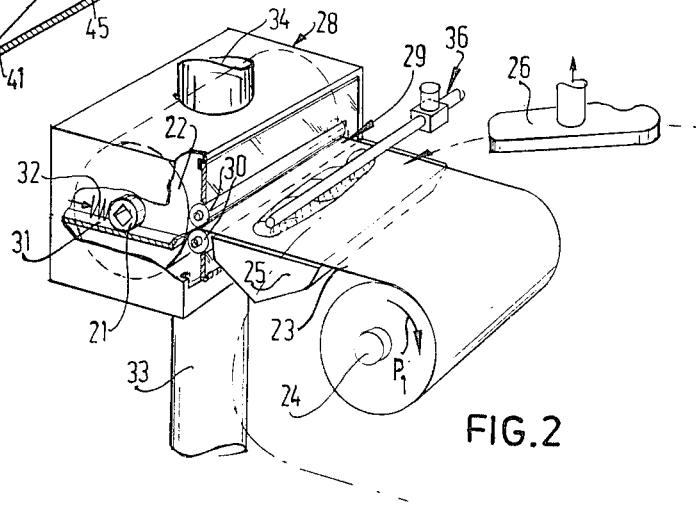
FIG.2

METHOD AND DEVICE FOR CONDITIONING TOBACCO LEAVES OR PARTS THEREOF IN A COIL OR BOBBIN

The invention relates to a method and a device for conditioning tobacco leaves or parts thereof in a coil or a bobbin in which the tobacco material is conducted towards or away from a stretched belt portion of a reel.

In cigar industry it has become common practice to store tobacco leaves or parts thereof between the turns of a wound belt. For this purpose a belt wound around a spindle is wound off at a tobacco treating machine, whilst a tobacco leaf or part thereof is each time deposited on the belt portion, after which the belt is rewound around a further spindle so that the tobacco portions are retained between the turns of the belt. With such a storing mode it is important for the conditions around the so-called bobbin to be maintained so that even after storage for several months no change of the tobacco leaf occurs, for example due to the formation of the fungi.

Conditioning of tobacco material may take place by drying the tobacco material, by reducing the ambient temperature of the bobbin or by treating the tobacco material with chemical substances.

When the tobacco material is taken out of the bobbin, the conditions of the tobacco have to be adapted to the state suitable for optimal treatment of the tobacco material. If, for example, the tobacco has been dried prior to storage, the tobacco material has afterwards to be wetted.

The invention has for its object to control the tobacco leaf material already during winding on or off respectively of the bobbin so that the aforesaid storage and treatment conditions respectively can be better controlled.

The method according to the invention is distinguished in that a conditioning medium is continuously fed to the windings of the bobbin containing the tobacco material and to at least part of the belt portion extending away therefrom.

Since herein conditioning is performed already at the insertion of the tobacco material into the bobbin or during the delivery of the tobacco material from the bobbin respectively, each tobacco leaf portion is treated in the same manner so that the entire contents of the bobbin exhibits equivalent properties.

The device according to the invention, which is suitable for treating tobacco material and comprises a spindle for the empty bobbin, as well as means for stretching the belt portion located between the bobbins is distinguished by a closed cabinet around the spindle for the filled bobbin, said cabinet having an opening for passing the belt portion and means for supplying and/or conducting away a conditioning medium.

This conditioning medium may be obtained from a commercial air conditioning system in which temperature and humidity can be adjusted.

The conditioning medium may, as an alternative, be formed by thermal radiation from an electrical radiator.

In a specific embodiment the conditioning medium may, in accordance with the invention, be formed by water which may be sprinkled on the tobacco material on the stretched belt portion.

The invention will be described more fully with reference to a few potential uses.

The drawing shows in:

FIG. 1 a perspective view of a device for filling a bobbin with tobacco material comprising a cabinet-like space in accordance with the invention, FIG. 2 a device for winding off the filled bobbin comprising a cabinet-like space and sprinkling means in accordance with the invention, FIG. 3 a specific embodiment of a cabinet accomodating both the filled and the empty bobbins.

The device shown in FIG. 1 for filling a bobbin with tobacco material is represented herein only by the most essential parts, which may be considered to be known and are lying around the scope of the invention so that further description may be omitted.

The device mainly comprises a reel 2 on a spindle 1, from which a belt 3 is wound off, said belt 3 being passed on to a spindle 4, which is rotated by driving means (not shown) so that the belt 3 is wound around the spindle 4.

Directly in front of spindle 4 a suction box 5 is arranged, the top side of which is perforated, above which top side is guided the stretched portion of the belt 3.

The device comprises furthermore a cutting bed 6, on which is each time deposited a tobacco leaf or part thereof by an operator, the cutting rollers 8 then cutting the desired portion from the tobacco material 7. A suction arm 9 adapted to reciprocate between the cutting bed 6 and the suction box 5 by turning around a shaft 10 picks up the tobacco leaf portion located inside the cutting edge of the cutting bed 6 and transports it to the belt portion above the suction box 5. As soon as the tobacco leaf portion is deposited on the belt portion the spindle 4 is turned through a given angle so that the tobacco leaf portion is clamped between the turns of the bobbin to be formed.

According to the invention a closed cabinet 11 is arranged around the spindle 4 and provided with a passage 12 for the belt 3 as well as an inlet opening 13 and an outlet opening 14 for the conditioning medium.

The openings 13 and 14 communicate with a conduit system (not shown) including, for example, a conditioning device 15, in which the conditioning medium is set to the desired temperature and humidity prior to being fed into the space of the cabinet 11. Through the outlet 14 the medium is conducted away and, if desired, recycled to the conditioning device 15.

The spindle 4 is supported on both sides by telescopic supporting arms 16 biassed by compression springs 17 to the left in FIG. 1. Thus it is ensured that the outer side of the bobbin presses against the rear side of the suction cabinet 5 so that an optimum operation is guaranteed.

As the size of the bobbin grows the spindle 4 withdraws to the right in FIG. 1. The arms 16 bear on the sidewall of the cabinet 11.

The cabinet 11 is equipped with a releasable sidewall for removing the full bobbin from the spindle 4; this may be the rear wall of the cabinet 11.

In the embodiment shown in FIG. 1 the opening 12 is closed on the one hand by the rear wall of the suction cabinet 5 and by flexible closing means 18, which prevent excessive loss of conditioning medium.

Owing to the comparatively small space around the bobbin to be filled, the tobacco leaf material is already conditioned on the suction cabinet 5 prior to being finally sandwiched between the turns of the bobbin. Nevertheless the tobacco leaf portions remaining in the outer turn are also subjected to the conditioning effect of the medium so that all tobacco leaf portions are equally conditioned.

The medium may be the normal ambient air brought to the desired temperature and humidity, but it may as well be a gaseous mixture having definite chemical properties for suppressing the growth of fungi.

FIG. 2 shows a device for winding off a filled bobbin, said device mainly comprising a spindle 21 carrying the filled bobbin 22 and a belt 23 drawn from the bobbin and wound around a spindle 24 of the device. The means for driving the spindle 24 are not shown, but they are of any suitable known type.

Between the two spindles is arranged a suction cabinet 25, the top wall of which is perforated, above which top is passed the belt portion extending between the windings. As soon as a tobacco leaf portion lying on the stretched belt portion arrives above the suction cabinet 25 a pick-up suction head 26 picks up the tobacco leaf portion from the stretched belt portion and conveys it to a treating station.

According to the invention the spindle 21 for the charged bobbin is surrounded by a cabinet 28 having a slot for passing the belt portion 23, said slot having a pair of rollers 30 on the bottom and top sides of the belt.

The spindle 21 is slidable at both ends on a support 31 provided in the cabinet 28 and biassed by compression springs 32 to the right in FIG. 2 towards the pair of rollers 30.

The cabinet 28 has on the top and bottom sides an inlet port 33 and an outlet port 34 respectively for a conditioning meadium.

Above the suction cabinet 25 is furthermore arranged a sprinkling apparatus for a liquid conditioning medium 36.

If after a long storage period a filled bobbin is transferred from a freezer or a refrigerator to the cabinet 28, which may be performed by temporarily removing the rear wall of the cabinet 28, a heating air stream may be subsequently passed via the inlet and outlet ports through the cabinet 28 for heating the tobacco leaf material.

If the tobacco material is too dry, it can be brought to the desired degree of humidity by the sprinkling apparatus 36.

For the sake of completeness it should be noted that this apparatus may also be used to form again a filled bobbin around the spindle 24. For this purpose the pick-up suction head 26 is omitted and the bobbin is wound opposite the direction of the arrow P1. Thus the tobacco material is again sandwiched between the turns.

The bobbin thus formed again may be employed for temporarily storing the tobacco material for further conditioning the same, if this takes some time subsequent to sprinkling.

FIG. 3 shows an enlarged cabinet 40, which is divided into two compartments by a separation partition 41. One compartment 42 serves for receiving a filled bobbin, whereas the compartment 43 receives the empty belt reel. These two windings are arranged on drivable spindles 44 and 45 respectively so that this cabinet-like space may be used in the device of FIG. 1 as well as in that of FIG. 2. The compartment 42 comprises an electric radiation element 46 having connecting means 47 for the electric source, whilst a slot 48 is provided for passing the belt portion between the windings. For the second compartment 43 only one slot 49 is provided for passing the belt portion back into the cabinet 40. Between the two slots the cabinet wall is perforated, said wall forming part of a suction channel 50, through which via the conduit 51 the space can be exhausted. Such a cabinet 40 is particularly suitable for use as a releasable cassette, which can be placed in the device of FIG. 1 as well as in that of FIG. 2. The mode of operation corresponds with that of the cabinets described with reference to FIGS. 1 and 2.

The invention is not limited to the embodiments described in the foregoing.

What is claimed is:

1. A device for treating tobacco material comprising a spindle for receiving a bobbin filled with tobacco material and a spindle for an empty bobbin, as well as means for stretching the belt portion between the two windings characterized by a closed cabinet around the spindle with the filled bobbin, said cabinet having a passage for the belt and having means for supplying and conducting away a conditioning medium.

2. A device as claimed in claim 1 characterized in that the cabinet is also arranged around the spindle for the empty bobbin, a second passage being provided for the belt portion.

3. A device as claimed in claim 1 or 2, characterized in that the cabinet wall between the passages is perforated and forms part of a suction channel.

4. A device as claimed in claims 4 or 2, characterized in that between the two spindles a separation partition is provided in the cabinet.

5. A device as claimed in claims 4 or 2, characterized in that the cabinet with the bobbin spindle(s) is releasably coupled with the device.

6. A device as claimed in claims 4 or 2, characterized in that the passage for the belt portion is covered by flexible closing means.

7. The method of conditioning tobacco leaves or parts thereof which comprises the steps of:

(a) confining a bobbin within a substantially closed space, the bobbin comprising a spirally wound air permeable belt having a plurality of spaced tobacco wrapper tobacco sandwiched between the windings thereof;

(b) maintaining a predetermined tobacco-conditioning atmosphere within said space while winding said belt between said bobbin and a reel spaced thereof and outside said spaced;

(c) maintaining a portion of said belt outside said space in stretched condition between said bobbin and said reel;

(d) depositing said tobacco on said stretched portion of the belt or removing said tobacco from the stretched portion of the belt, dependent upon the direction of winding of step (b);

(e) locating the bobbin in said space such that a portion of said belt within said space is in unwound condition whereby any tobacco present thereon is exposed directly to said atmosphere.

8. The method defined in claim 7 including the step of subjecting the belt to vacuum, immediately adjacent and within said space, on that side thereof opposite the tobacco whereby to bleed said atmosphere through said unwound portion of the belt and any tobacco thereon is subjected to the passage of said atmosphere therethrough.

9. The method as defined in either one of claimes 7 or 8 wherein step (b) comprises continuously circulating humidity-controlled air through said space.

10. The method as defined in either one of claims 7 or 8 wherein step (b) comprises heating the atmosphere within said space.

11. The method of conditioning tobacco wrappers such that a product of substantially uniform condition is supplied to a point of use, which comprises the steps of:

(a) successively placing the tobacco wrappers on a permeable belt and winding the belt to form a bobbin which comprises the permeable belt wound upon itself in spiral fashion, the wrappers being sandwiched flatwise between successive windings of the belt and in spaced relation to each other;

(b) confining the bobbin of step (a) within a substantially closed space and maintaining a humidity-controlled atmosphere within such space as the wrappers are stored whereby all of the wrappers in the bobbin are brought to a predetermined condition;

(c) storing said bobbin in such fashion as tends to preserve said predetermined condition thereof;

(d) preparing the tobacco wrappers in said bobbin for use by subjecting the bobbin to a further confined atmosphere while unwinding the belt from the bobbin to present the wrappers sequentially to a station external to such confined atmosphere in said substantially uniform condition; and (e) removing said wrappers sequentially from said station for use.

12. The method as defined in claim 11 including the step of moisturizing said wrappers external to the space of step (d) but prior to the removal of step (e).

* * * * *